US007814605B1

(12) United States Patent
Tippel

(10) Patent No.: US 7,814,605 B1
(45) Date of Patent: Oct. 19, 2010

(54) FLOOR WASHING SYSTEM

(76) Inventor: Austin L. Tippel, 65 Cove Road, London, Ontario (CA) N6j-1h8

( * ) Notice: Subject to any disclaimer, the term of this patent is extended or adjusted under 35 U.S.C. 154(b) by 545 days.

(21) Appl. No.: 11/804,988

(22) Filed: May 22, 2007

(51) Int. Cl.
*A43B 3/26* (2006.01)

(52) U.S. Cl. ..... 15/114; 15/227; 36/97; 36/132; 36/136

(58) Field of Classification Search ..... 15/49.1, 15/105, 114, 176.2, 176.3, 227; 36/97, 132, 36/136
See application file for complete search history.

(56) References Cited

U.S. PATENT DOCUMENTS

| | | | | | |
|---|---|---|---|---|---|
| 2,114,790 | A | * | 4/1938 | Venables | 482/105 |
| 4,122,577 | A | * | 10/1978 | Catania | 15/160 |
| 4,399,581 | A | * | 8/1983 | Tuzzolino | 15/176.3 |
| 5,644,813 | A | | 7/1997 | Puskas | |
| 5,794,362 | A | * | 8/1998 | Polk et al. | 36/97 |
| D411,240 | S | * | 6/1999 | Risko | D2/916 |
| 6,052,856 | A | | 4/2000 | DeMoya et al. | |
| 6,134,741 | A | | 10/2000 | Spalione | |
| 6,145,156 | A | | 11/2000 | Pullara, Jr. et al. | |
| 6,273,628 | B1 | | 8/2001 | Chen | |
| 6,430,771 | B2 | * | 8/2002 | Ahern | 15/118 |
| 6,732,397 | B2 | * | 5/2004 | Thompson | 15/160 |
| 7,055,268 | B2 | * | 6/2006 | Ha | 36/97 |
| 2002/0170206 | A1 | * | 11/2002 | Chil et al. | 36/97 |
| 2004/0107604 | A1 | * | 6/2004 | Ha | 36/97 |
| 2007/0240330 | A1 | * | 10/2007 | Beasley | 36/7.2 |

* cited by examiner

*Primary Examiner*—Monica S Carter
*Assistant Examiner*—Stephanie Newton

(57) ABSTRACT

A floor washing system includes a foot covering that with a sole, a heal end and a toe end. A panel has a bottom side, a top side and a peripheral edge. The panel includes a peripheral lip that is coextensive with the peripheral edge. The panel has a front edge, a back edge and a pair of lateral edges. The panel has a break therein extending through the lateral edges to define a first portion and a second portion of the panel. A coupler extends between and secures together the first and second portions at a selected length from each other. A plurality of cleaning assemblies is removably attached to the bottom side of the panel. The foot covering is positioned on a foot, the sole placed on the top side of the panel and the cleaning assemblies used to clean a floor.

7 Claims, 5 Drawing Sheets

FLOOR WASHING SYSTEM

BACKGROUND OF THE INVENTION

1. Field of the Invention

The present invention relates to floor washing devices and more particularly pertains to a new floor washing device for attaching to a person's feet so that they can use their feet for washing a floor surface.

2. Description of the Prior Art

The use of floor washing devices is known in the prior art. While these devices fulfill their respective, particular objectives and requirements, the need remains for a device that can be attached to a person's footwear so that the person can wash a floor surface with leg movements.

SUMMARY OF THE INVENTION

The present invention meets the needs presented above by generally comprises a foot covering that includes a sole, a heal end and a toe end. A panel has a bottom side, a top side and a peripheral edge. The panel includes a peripheral lip that is attached to the top side and extends upwardly therefrom. The peripheral lip is coextensive with the peripheral edge. The panel has a front edge, a back edge and a pair of lateral edges. The panel has a break therein extending through the lateral edges to define a first portion and a second portion of the panel. The first portion includes the front edge. A coupler extends between and secures together the first and second portions. The coupler is actuated to selectively adjust a distance between the first and second portions. A plurality of cleaning assemblies is removably attached to the bottom side of the panel. The foot covering is positioned on a foot, the sole placed on the top side of the panel and the cleaning assemblies used to clean a floor. A distance between the first and second portions may be adjusted according to a length of the sole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
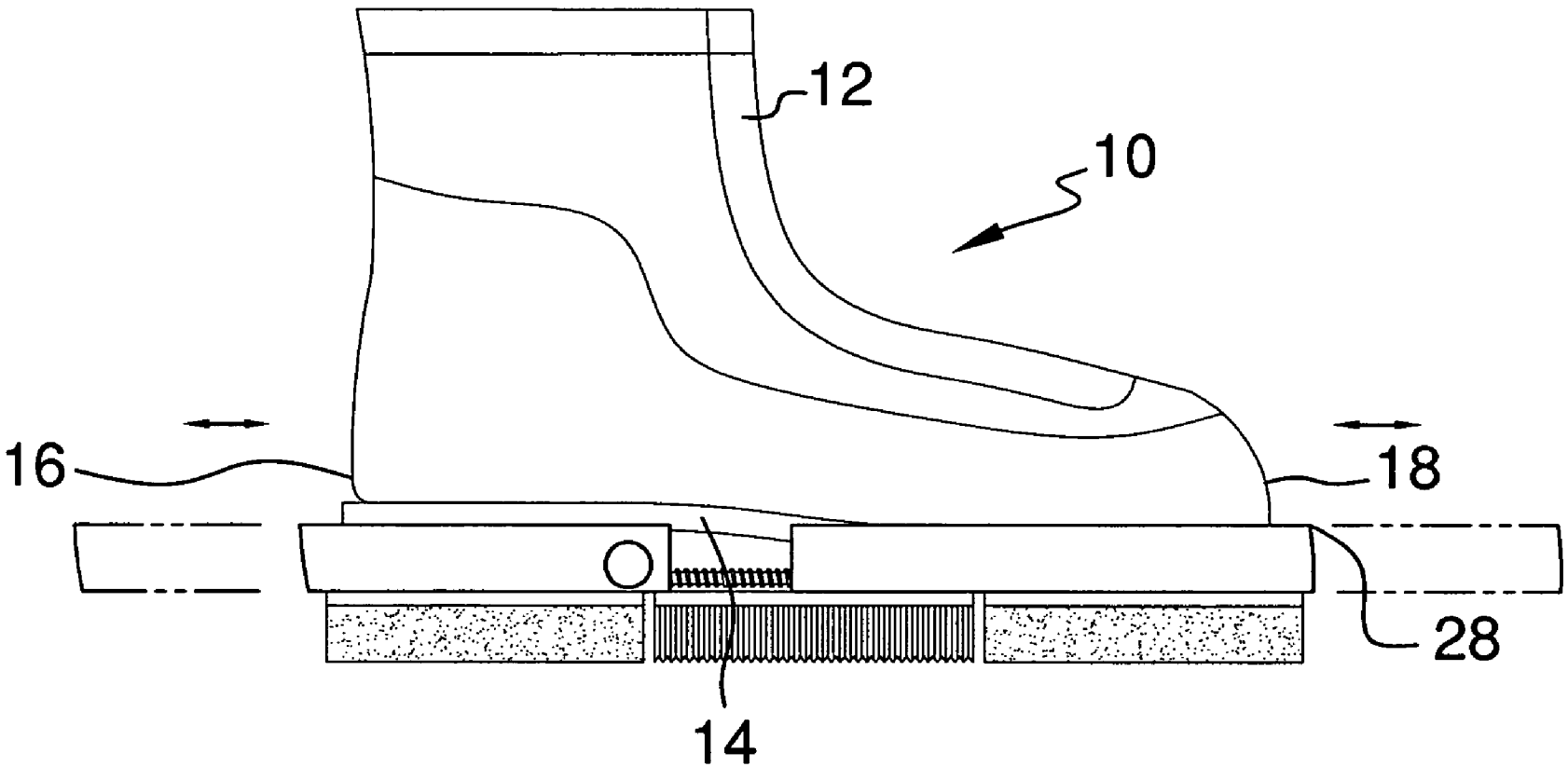
FIG. 1 is a side view of a floor washing system according to the present invention.
Figure 2:
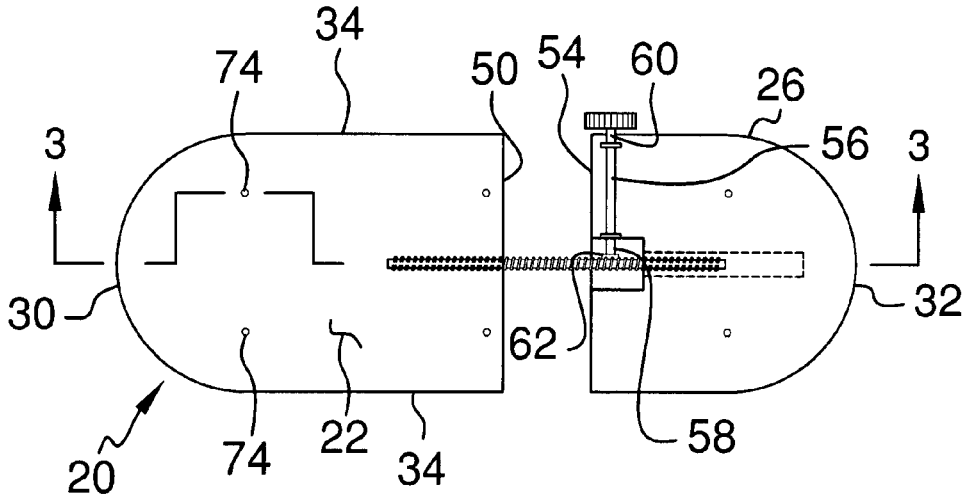
FIG. 2 is a bottom view of a panel the present invention.
Figure 3:
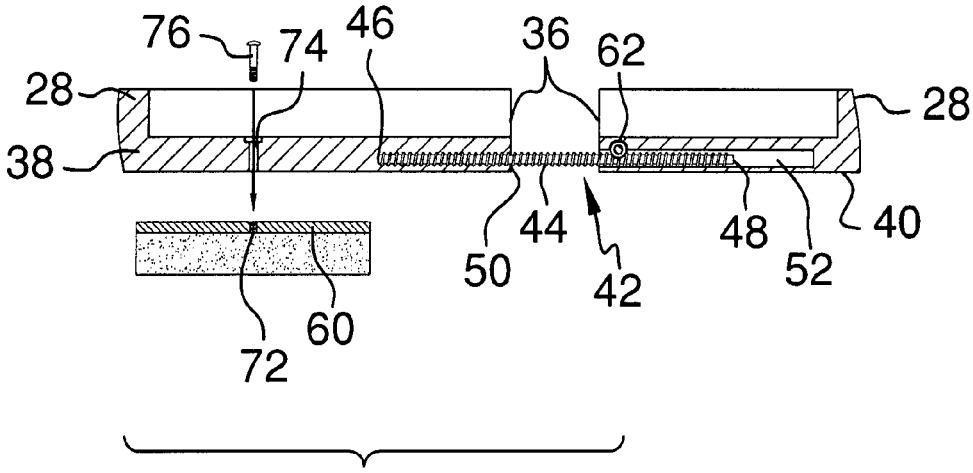
FIG. 3 is a cross-sectional view taken along line 3-3 of FIG. 2 of the present invention.
Figure 4:
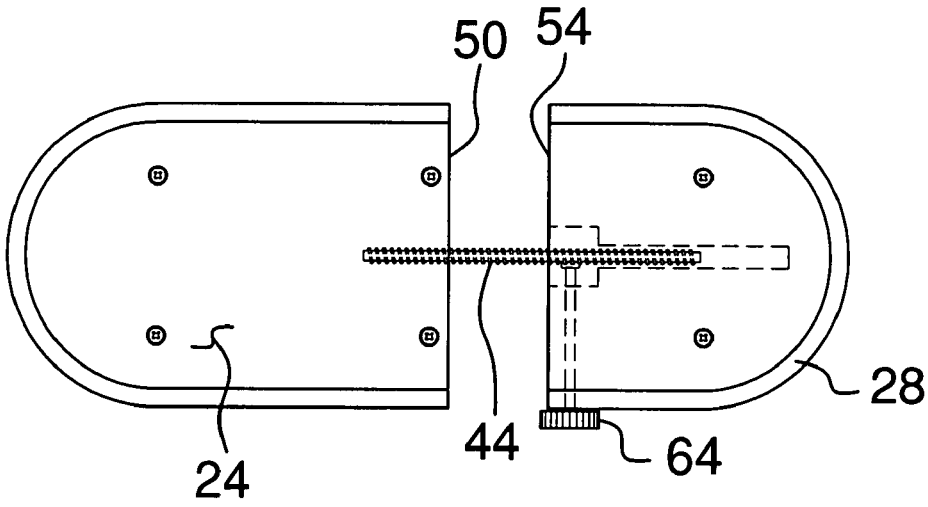
FIG. 4 is a top view of the panel of the present invention.

With reference now to the drawings, and in particular to FIGS. 1 through 7 thereof, a new floor washing device embodying the principles and concepts of the present invention and generally designated by the reference numeral 10 will be described.

As best illustrated in FIGS. 1 through 7, the floor washing system 10 generally comprises a foot covering 12 that including a sole 14, a heal end 16 and a toe end 18. The foot covering 12 can comprise any conventional footwear.

A panel 20 has a bottom side 22, a top side 24 and a peripheral edge 26. The panel 20 includes a peripheral lip 28 that is attached to the top side 24 and extends upwardly therefrom. The peripheral lip 28 is coextensive with the peripheral edge 26. The panel 20 has a front edge 30, a back edge 32 and a pair of lateral edges 34. The panel 20 has a break 36 therein extending through the lateral edges 34 to define a first portion 38 and a second portion 40 of the panel 20. The first portion 38 includes the front edge 30. The break 36 is positioned at least three inches from each of the front 30 and back 32 edges. Each of the front 30 and back edges is convexly arcuate.

A coupler 42 extends between and secures together the first 38 and second 40 portions. The coupler 42 is actuated to selectively adjust a distance between the first 38 and second 40 portions. The coupler 42 includes a threaded rod 44 that has a first end 46 and a second end 48. The first end 46 extends into a distal edge 50 of the first portion 38 with respect to the front edge 30. The first end 46 is securely attached to the first portion 38. The second end 48 extends into a well 52 extending into a distal end 54 of the second portion 40 with respect to the back edge 32. A shaft 56 extends into the peripheral edge 34 of the second portion 40. The shaft 56 has an inner end 58 positioned within the second portion 40 and an outer end 60 extending outwardly from the second portion 40. A gear 62 is attached to the inner end 58 and is mechanically coupled to the rod 44. The rod 44 is moved inward of the second portion 40 when the gear 62 is rotated in a first direction and outward of the second portion 40 when the gear 62 is rotated in a second direction. A grip 64 is attached to the outer end 60 of the shaft 56 to facilitate rotation of the shaft 56.

Figure 5:
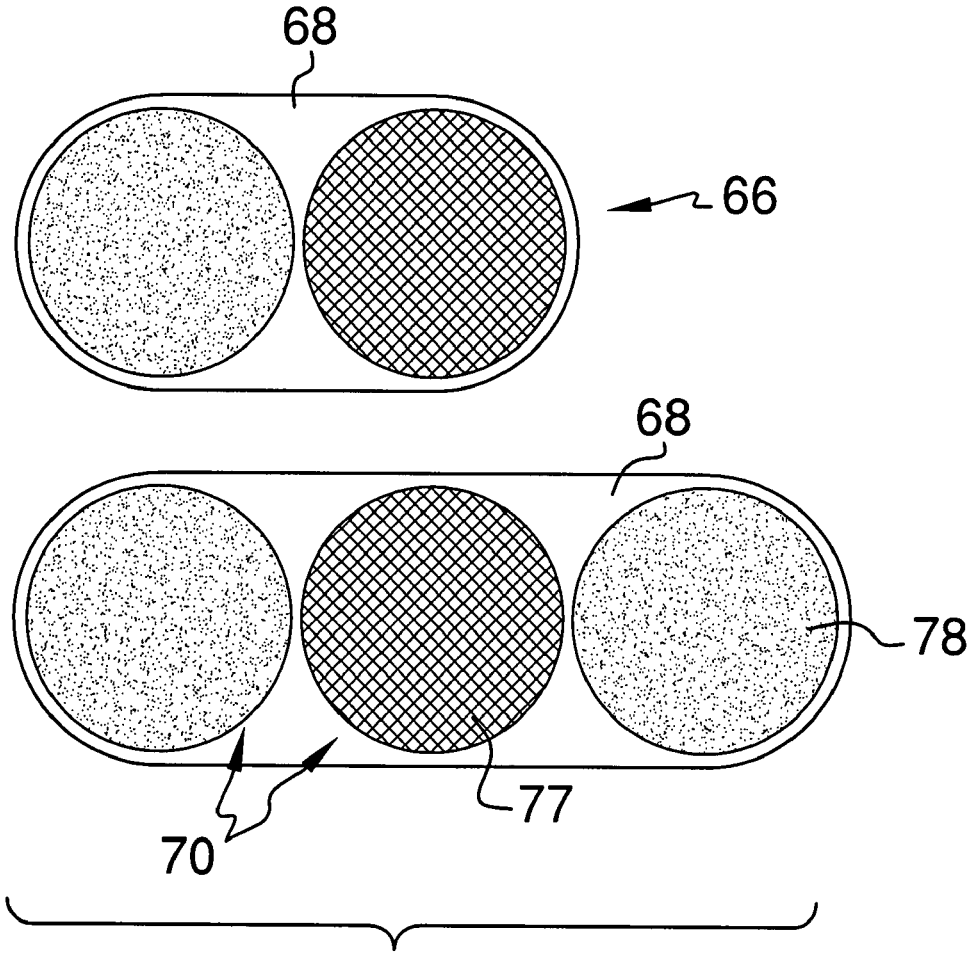
FIG. 5 is a bottom view of cleaning assemblies of the present invention.
Figure 6:
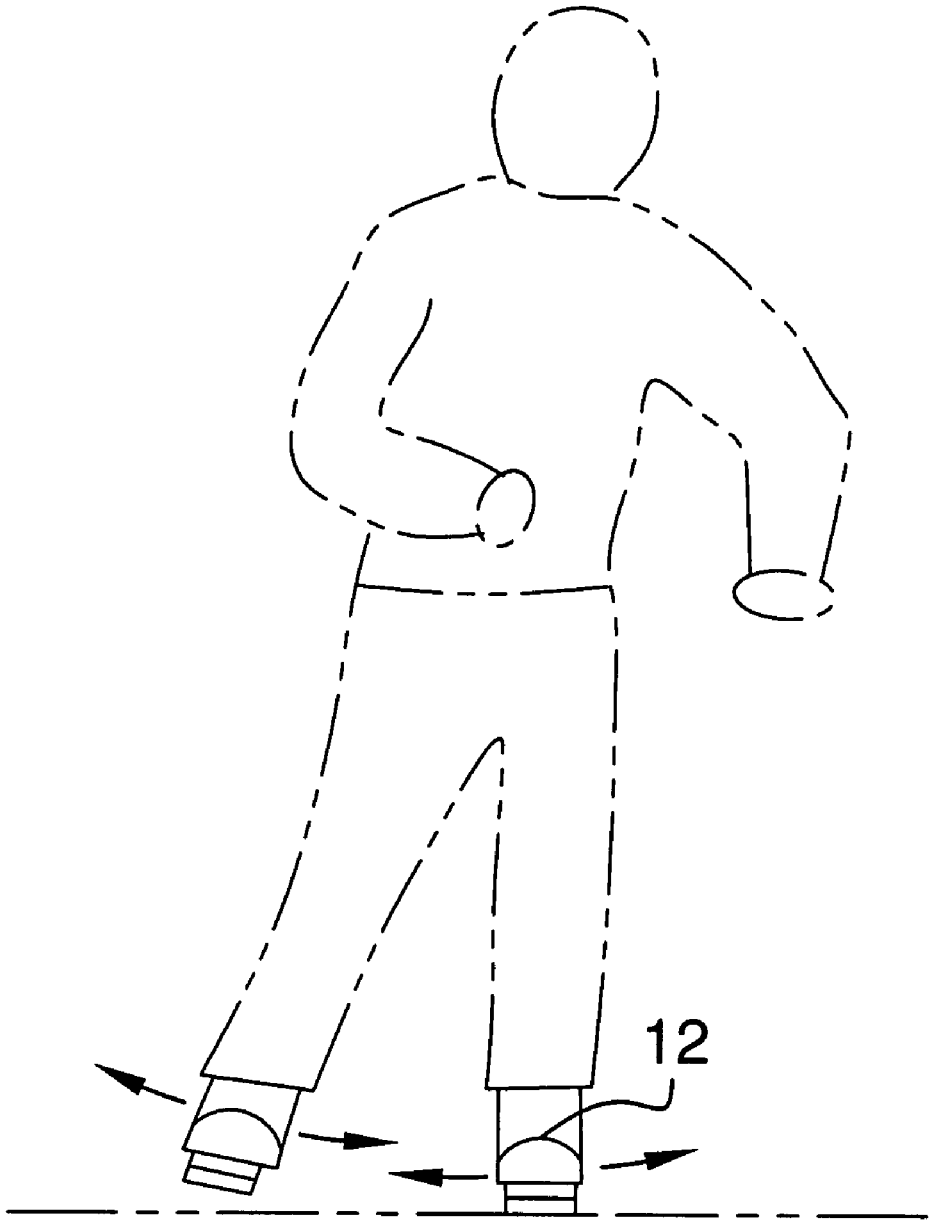
FIG. 6 is a front view of the present invention.

A plurality of cleaning assemblies 66 is removably attached to the bottom side 22 of the panel 20. Each of the cleaning assemblies 66 includes a plate 68 and a cleansing implement 70 attached to and extending downwardly from the plate 68. Each of the plates 68 has at least one threaded aperture 72 extending therein. The threaded apertures 72 of the cleaning assemblies 66 are alignable with one of a plurality of openings 74 extending through the panel 20. Each of a plurality of fasteners 76 is extendable through one of the openings 74 and threadably coupled to an aligned one of the threaded apertures 72. Each of the first 38 and second 40 portions includes at least opening 74. At least one of the cleaning assemblies 66 includes a cleaning implement 70 comprising a plurality of bristles 77. At least one of the cleaning assemblies 66 includes a cleaning implement 70 comprising a sponge 78 material. As shown in FIG. 5, the plates 68 may have more than one cleaning implement thereon 70.

Figure 7:
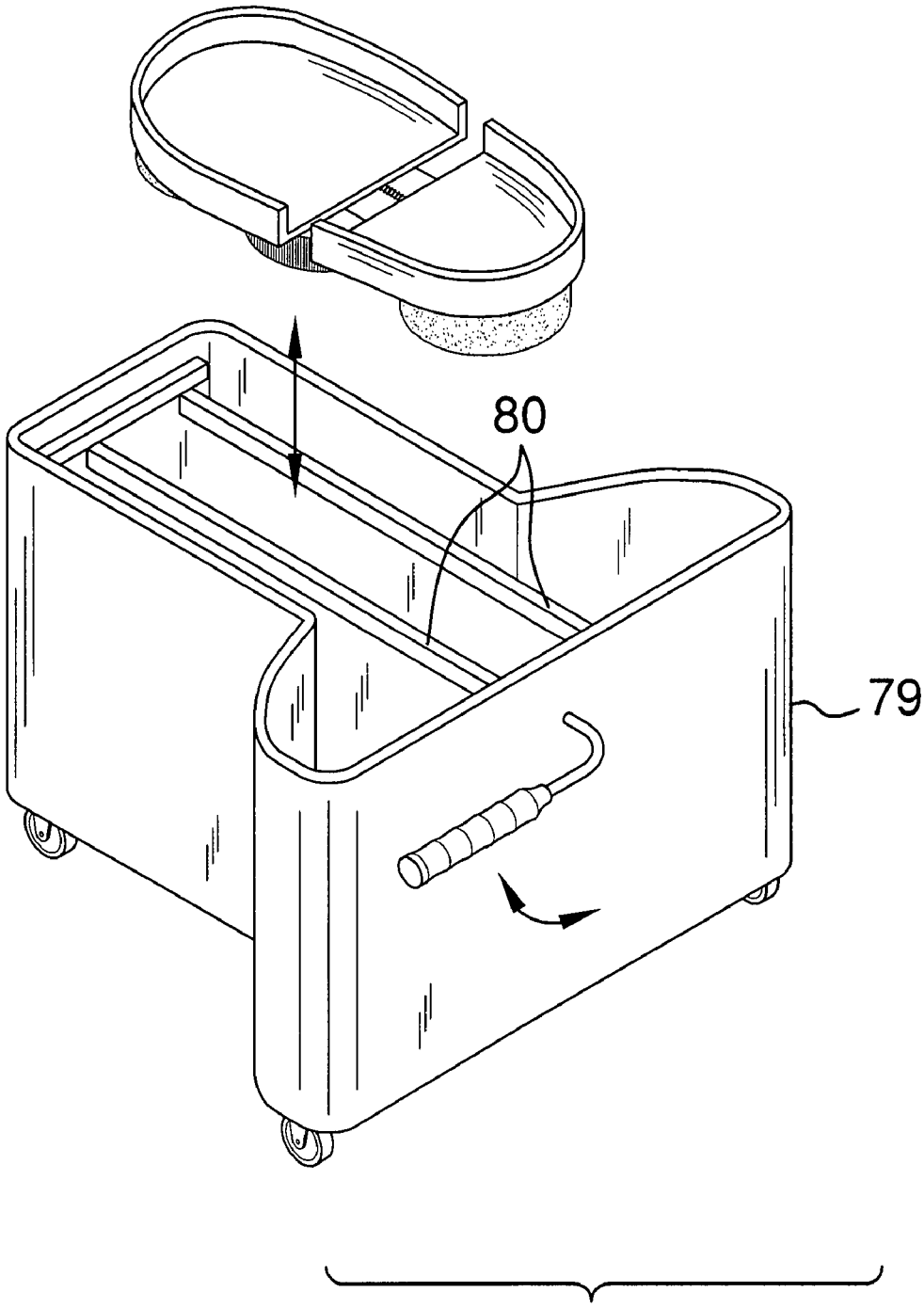
FIG. 7 is a perspective view of a bucket of the present invention.

In use, the foot covering 12 is positioned on a foot and the sole 14 placed on the top side 24 of the panel 20. The wearer of the system 10 then uses the cleaning assemblies 66 to clean a floor by moving the cleaning assemblies 66 across a floor surface. This may be done in a back and forth motion with the wearer's legs. A distance between the first 38 and second 40 portions may be adjusted according to a length of the sole 14 so that the cleaning assemblies 66 fit any foot covering. FIG. 7 includes a modified mop bucket 79 having walls 80 that move laterally to squeeze the cleaning implements of the cleaning assemblies 66.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floor washing system comprising:

a foot covering including a sole, a heal end and a toe end;

a panel having a bottom side, a top side and a peripheral edge, said panel including a peripheral lip being attached to said top side and extending upwardly therefrom, said peripheral lip being coextensive with said peripheral edge, said panel having a front edge, a back edge and a pair of lateral edges, said panel having a break therein extending through said lateral edges to define a first portion and a second portion of said panel, said first portion including said front edge;

a coupler extending between and securing together said first and second portions, said coupler being actuated to selectively adjust a distance between said first and second portions;

a plurality of cleaning assemblies being removably attached to said bottom side of said panel;

each of said cleaning assemblies includes a plate and a cleansing implement attached to and extending downwardly from said plate, each of said plates having at least one threaded aperture extending therein, said threaded apertures of said cleaning assemblies being alignable with one of a plurality of openings extending through said panel, each of a plurality of fasteners being extendable through one of said openings and threadably coupled to an aligned one of said threaded apertures, each of said first and second portions including at least opening; and wherein the foot covering is positioned on a foot and the sole placed on the top side of said panel and the cleaning assemblies used to clean a floor, wherein a distance between said first and second portions may be adjusted according to a length of the sole.

2. The system according to claim 1, wherein said break is at least three inches from each of said front and back edges.

3. The system according to claim 1, wherein each of said front and back edges being convexly arcuate.

4. The system according to claim 1, wherein said coupler includes:

a threaded rod having a first end and a second end, said first end extending into a distal edge of said first portion with respect to said front edge, said first end being securely attached to said first portion, said second end extending into a well extending into a distal end of said second portion with respect to said back edge;

a shaft extending into said peripheral edge of said second portion, said shaft having an inner end positioned within said second portion and an outer end extending outwardly from said second portion; and a gear being attached to said inner end and being mechanically coupled to said rod, said rod moving inward of said second portion when said gear is rotated in a first direction and outward of said second portion when said gear is rotated in a second direction.

5. The system according to claim 4, wherein said coupler further includes a grip being attached to said outer end of said shaft to facilitate rotation of said shaft.

6. The system according to claim 1, wherein at least one of said cleaning assemblies includes a cleaning implement comprising a plurality of bristles and at least one of said cleaning assemblies includes a cleaning implement comprising a sponge material.

7. A floor washing system comprising:

a foot covering including a sole, a heal end and a toe end;

a panel having a bottom side, a top side and a peripheral edge, said panel including a peripheral lip being attached to said top side and extending upwardly therefrom, said peripheral lip being coextensive with said peripheral edge, said panel having a front edge, a back edge and a pair of lateral edges, said panel having a break therein extending through said lateral edges to define a first portion and a second portion of said panel, said first portion including said front edge, said break being at least three inches from each of said front and back edges, each of said front and back edges being convexly arcuate;

a coupler extending between and securing together said first and second portions, said coupler being actuated to selectively adjust a distance between said first and second portions, said coupler including;

a threaded rod having a first end and a second end, said first end extending into a distal edge of said first portion with respect to said front edge, said first end being securely attached to said first portion, said second end extending into a well extending into a distal end of said second portion with respect to said back edge;

a shaft extending into said peripheral edge of said second portion, said shaft having an inner end positioned within said second portion and an outer end extending outwardly from said second portion;

a gear being attached to said inner end and being mechanically coupled to said rod, said rod moving inward of said second portion when said gear is rotated in a first direction and outward of said second portion when said gear is rotated in a second direction;

a grip being attached to said outer end of said shaft to facilitate rotation of said shaft;

a plurality of cleaning assemblies being removably attached to said bottom side of said panel, each of said cleaning assemblies including a plate and a cleansing implement attached to and extending downwardly from said plate, each of said plates having at least one threaded aperture extending therein, said threaded apertures of said cleaning assemblies being alignable with one of a plurality of openings extending through said panel, each of a plurality of fasteners being extendable through one of said openings and threadably coupled to an aligned one of said threaded apertures, each of said first and second portions including at least opening, at least one of said cleaning assemblies including a cleaning implement comprising a plurality of bristles, at least one of said cleaning assemblies including a cleaning implement comprising a sponge material; and wherein the foot covering is positioned on a foot and the sole placed on the top side of said panel and the cleaning assemblies used to clean a floor, wherein a distance between said first and second portions may be adjusted according to a length of the sole.

* * * * *